United States Patent [19]

Fukaya et al.

[11] Patent Number: 4,633,751

[45] Date of Patent: Jan. 6, 1987

[54] AUTOMATIC PERFORMANCE APPARATUS

[75] Inventors: Hideshi Fukaya, Oume; Toshifumi Hoshii, Fussa; Keiji Yuzawa, Akishima, all of Japan

[73] Assignee: Casio Computer Co., Ltd., Tokyo, Japan

[21] Appl. No.: 722,764

[22] Filed: Apr. 15, 1985

Related U.S. Application Data

[63] Continuation of Ser. No. 513,107, Jul. 12, 1983, abandoned.

[30] Foreign Application Priority Data

Jul. 15, 1982 [JP] Japan ..... 57-122160

[51] Int. Cl.[4] ..... G10F 1/00

[52] U.S. Cl. ..... 84/1.03; 84/DIG. 22

[58] Field of Search ..... 84/1.03, 1.01, 1.28, 84/1.24, DIG. 22

[56] References Cited

U.S. PATENT DOCUMENTS

| | | | |
|---|---|---|---|
| 4,022,097 | 5/1977 | Strangio | 84/1.03 |
| 4,387,620 | 6/1983 | Okamoto et al. | 84/1.03 |
| 4,432,266 | 2/1984 | Nakada | 84/1.03 |
| 4,448,104 | 5/1984 | Hoshii | 84/1.03 |
| 4,476,763 | 10/1984 | Uya et al. | 84/1.03 |

*Primary Examiner*—Forester W. Isen

*Attorney, Agent, or Firm*—Frishauf, Holtz, Goodman & Woodward

[57] ABSTRACT

An automatic performance apparatus includes input circuitry for serially inputting musical sound information of a predetermined melody and musical sound information to be imparted to the melody, in accordance with progressions of the melody and a chord. A storage device serially stores the musical sound information inputted, and readout circuitry successively reads out the musical sound information stored in the storage device. Accordingly, the musical sounds based on the read out musical sound information are reproduced, and a melody and a chord are played simultaneously.

16 Claims, 15 Drawing Figures

MEMORY PORTION
A
25
ADDRESS COUNTER
26
U/D +1 R R/W
22
CONTROL UNIT
CR
MR
IKM
IKC
PLAY
REC
OFF
9
DISPLAY PORTION
8
MUSICAL SOUND GENERATOR UNIT
23
24
KEY MATRIX
21
3
31A
31
31B
COINCIDENCE CIRCUIT
29
COINCIDENCE CIRCUIT
33
CHORD LENGTH COUNTER
32
CR'
34
NOTE LENGTH COUNTER
28
MR'
30
27A
27
27B
35
RESET
5k
AUTO PLAY
5h
ONE-KEY MELODY KEY
7a
ONE-KEY CHORD KEY
7b

Fig. 4

| SCALE | CODE | | | | | SCALE | CODE | | | | |
|---|---|---|---|---|---|---|---|---|---|---|---|
| F4 | 0 | 0 | 0 | 0 | 1 | A5 | 1 | 0 | 0 | 0 | 1 |
| F#4 | 0 | 0 | 0 | 1 | 0 | A#5 | 1 | 0 | 0 | 1 | 0 |
| G4 | 0 | 0 | 0 | 1 | 1 | B5 | 1 | 0 | 0 | 1 | 1 |
| G#4 | 0 | 0 | 1 | 0 | 0 | C6 | 1 | 0 | 1 | 0 | 0 |
| A4 | 0 | 0 | 1 | 0 | 1 | C#6 | 1 | 0 | 1 | 0 | 1 |
| A#4 | 0 | 0 | 1 | 1 | 0 | D6 | 1 | 0 | 1 | 1 | 0 |
| B4 | 0 | 0 | 1 | 1 | 1 | D#6 | 1 | 0 | 1 | 1 | 1 |
| C5 | 0 | 1 | 0 | 0 | 0 | E6 | 1 | 1 | 0 | 0 | 0 |
| C#5 | 0 | 1 | 0 | 0 | 1 | F6 | 1 | 1 | 0 | 0 | 1 |
| D5 | 0 | 1 | 0 | 1 | 0 | F#6 | 1 | 1 | 0 | 1 | 0 |
| D#5 | 0 | 1 | 0 | 1 | 1 | G6 | 1 | 1 | 0 | 1 | 1 |
| E5 | 0 | 1 | 1 | 0 | 0 | G#6 | 1 | 1 | 1 | 0 | 0 |
| F5 | 0 | 1 | 1 | 0 | 1 | A6 | 1 | 1 | 1 | 0 | 1 |
| F#5 | 0 | 1 | 1 | 1 | 0 | A#6 | 1 | 1 | 1 | 1 | 0 |
| G5 | 0 | 1 | 1 | 1 | 1 | B6 | 1 | 1 | 1 | 1 | 1 |
| G#5 | 1 | 0 | 0 | 0 | 0 | DUMMY | 0 | 0 | 0 | 0 | 0 |

Fig. 5A

| ROOT | CODE | | | |
|---|---|---|---|---|
| C | 0 | 0 | 0 | 1 |
| C# | 0 | 0 | 1 | 0 |
| D | 0 | 0 | 1 | 1 |
| D# | 0 | 1 | 0 | 0 |
| E | 0 | 1 | 0 | 1 |
| F | 0 | 1 | 1 | 0 |
| F# | 0 | 1 | 1 | 1 |
| G | 1 | 0 | 0 | 0 |
| G# | 1 | 0 | 0 | 1 |
| A | 1 | 0 | 1 | 0 |
| A# | 1 | 0 | 1 | 1 |
| B | 1 | 1 | 0 | 0 |

Fig. 5B

| SORT | CODE | | | |
|---|---|---|---|---|
| major | 0 | 0 | 0 | 1 |
| minor | 0 | 0 | 1 | 0 |
| 7 | 0 | 0 | 1 | 1 |
| maj7 | 0 | 1 | 0 | 0 |
| m7 | 0 | 1 | 0 | 1 |
| sus4 | 0 | 1 | 1 | 0 |
| dim | 0 | 1 | 1 | 1 |
| 6 | 1 | 0 | 0 | 0 |
| min6 | 1 | 0 | 0 | 1 |

Fig. 6

CAMPTOWN RACES

Allegro mf D A7 f

De Camptown la-dies sing dig song Doo-dahmf D doo-dah- De Camptown race-track five miles long A7 f D mf Oh doo-dah-day! come down dah wid my hat cared in

A7 D

Doo-dah doo-dah! I go back home wid a

A7 D pock-et full of tin Oh doo-dah- dayf G D mf

Gwine to run all night Gwine to run all day! I'll-

A7 f D bet my money on de boh-tail nag. Some body bet on de bay.

AUTOMATIC PERFORMANCE APPARATUS

This application is a continuation of application Ser. No. 513,107, filed July 12, 1983 now abandoned.

BACKGROUND OF THE INVENTION

The present invention relates to automatic performance apparatus, and more particularly to an automatic performance apparatus which can play a chord simultaneously with a melody.

With the progress of digital technologies, some recent electronic musical instruments put into practical use can, not only produce many kinds of tone colors by the single instrument, but also store musical sound information and give an automatic performance.

Such electronic musical instruments include ones which have a performance function called "one-key play". In the electronic musical instrument of this type, in order to store the musical sound information, only the musical scale information of a melody are first stored into a memory by a keyboard operation without considering the lengths of musical notes or a tempo, whereupon the note lengths are added to the scale information by the timings of the operations of a key called "one-key play key". More specifically, at the point of time at which the one-key play key is depressed, the scale information corresponding to one note is read out from the memory. The period of time from this point of time till the next depression of the one-key play key is added to the scale information and stored as the length of the particular note. The musical sound information which includes the musical scale and note lengths thus stored are automatically read out by operating predetermined keys, whereby the automatic performance is executed.

With such conventional automatic performance, however, only the melody is played, which has led to the disadvantage that the performance becomes monotonous as music.

As electronic musical instruments which solve the disadvantage, there have also been put into practical use ones which automatically play an accompaniment, namely, a chord along with the melody. In the electronic musical instrument of this type, the musical sound information of the chord such as the sort, root and length of the chord need to be stored besides the melody. To this end, the prior art has been furnished with separate memories or a single memory which is functionally divided into two sections, so as to store the musical sound information of the melody in one memory (section) and those of the chord in the other memory (section). At the performance, the musical sound information have been successively read out from the respective memories (memory sections), and both the musical sounds have been synchronized and emitted.

With such method, however, since the separate memories (memory sections) are used for the melody and the chord, a circuit for synchronizing both the musical sounds to be read out is indispensable. This has led to the disadvantage of complexity in the arrangement of a read control circuit and also in a read control program.

A further disadvantage is that, due to the memory structure as described above, a large memory area is inevitably unused, so the memory capacity, in effect, becomes unnecessarily large.

SUMMARY OF THE INVENTION

An object of the present invention is to provide an automatic performance apparatus which can simultaneously play a melody and a chord with a simplified read control circuit for melody information and chord information and with a small memory capacity.

In one aspect of performance of the present invention, an automatic performance apparatus comprises input means for serially inputting musical sound information of a predetermined melody and musical sound information of a chord to be imparted to the melody, in accordance with progressions of the melody and the chord; storage means for serially storing the musical sound information inputted by the input means; read means for reading out the musical sound information stored in the storage means; and musical sound producing means for producing musical sounds based on the musical sound information successively read out by the read means.

BRIEF DESCRIPTION OF THE DRAWINGS

FIG. 4 is a table showing the contents of binary codes which express the scales of the melody;

FIGS. 5A and 5B are tables showing the contents of binary codes which express the roots and sorts of the chords, respectively;

FIG. 6 is a diagram showing the musical score of "Camptown Races";

PREFERRED EMBODIMENT OF THE INVENTION

Figure 1:
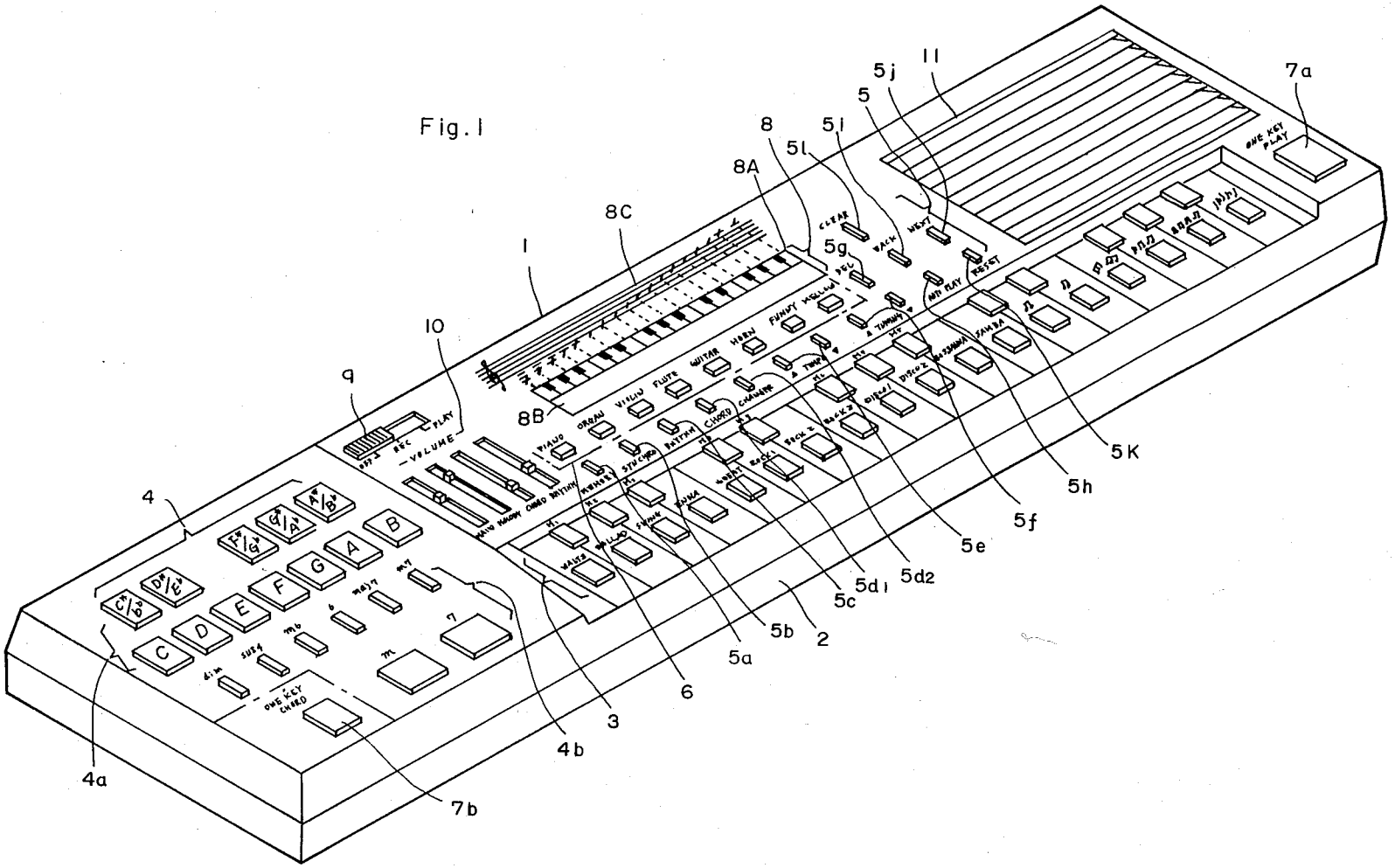
FIG. 1 is an exterior perspective view of a portable automatic performance apparatus which is an embodiment of the present invention.

FIG. 1 is an exterior perspective view of a portable automatic performance apparatus according to the present invention. A group of play keys 3 comprising thirty-one keys are arrayed on the front part of a body case 2. A group of chord assignment keys 4 are disposed on the left side of the group of play keys 3. Arrayed above the group of play keys 3 are a group of control keys 5 for putting a musical piece (melody) into a memory so as to effect an automatic performance, and a group of tone color selection keys 6 for selecting the tone colors of musical sounds. On the front parts of the body case 2 at both the ends thereof, there are disposed a key *7a* (hereinbelow, termed "one-key melody key") and a key *7b* (hereinbelow, termed "one-key chord key") for one-key play which serve to impart any desired note length and chord length to a musical scale and a chord written in the memory, respectively.

Program information which include musical sound information, such as the scale and the chord, obtained by operating these keys are indicated on a display portion 8 which has a liquid-crystal panel.

The respective modes of power-off (OFF), a play mode (PLAY) and a recording mode (REC) are assigned by the use of a mode change-over switch 9.

The musical sounds obtained by the various operations described above have their sound volumes controlled properly by a group of volume control switches 10, and then emitted from a sound emitting portion 11. The body case 2 receives therein circuitry, a loudspeaker, etc. in the present embodiment for playing the melody and the chord simultaneously.

The memory portion can be used as eight divided sections through the operation of a memory key *5a* in the group of control keys 5 and the operations of some ($M_1$–$M_8$) of those keys in the group of play keys 3 which correspond to black keys. The playing sequence of the respective memory sections can be programed so as to use the same memory section for refrain parts. Further, any one of twelve rhythm patterns of waltz, bossa nova, etc. or six arpeggio patterns can be selected through the operation of a rhythm key *5c* in the group of control keys 5 and the operations of those keys in the group of play keys 3 which correspond to white keys.

The group of volume control switches 10 can regulate the sound volume of the whole piece and the respective sound volumes of the melody, chord and rhythm separately from one another.

Now, the designations and functions of the control keys 5 except those already stated will be briefly described.

An auto play key *5h* is a key for automatically performing the musical piece written in the memory. The ways of writing a musical piece into the memory and automatically playing the written musical piece will be explained in detail later.

A reset key *5k* serves to stop the automatic performance and to call the beginning of the stored musical piece. That is, when this key is depressed, the address of the memory jumps to the head of the musical piece information.

A clear key *5l* serves to clear the content of the memory. Besides, there are a synchro start key *5b* for synchronizing a chord sound and a rhythm sound, a chord key $5d_1$ for automatically imparting a chord to the musical piece written in the memory, a change key $5d_2$ for partly changing the chord, tempo keys *5e* for controlling a rhythm tempo, tuning keys *5f* for sharping and flatting the gamut of the keys, a delete key *5g* for partly deleting the musical sound information written in the memory, a back key *5i* for retreating the musical sound information every step, and a next key *5j* for advancing the musical sound information every step.

The group of chord assignment keys 4 comprise a group of root assignment keys *4a* and a group of chord sort selection keys *4b*. 9 (Nine) sorts of chords can be selected for each of 12 (twelve) roots, and 108 (one hundred and eight) sorts of chords in total can be outputted.

The display portion 8 comprises a musical scale display section 8A which is arrayed in the shape of a keyboard, and a character display section 8B which underlies the section 8A and which indicates the chord and other performance information. Over the scale display section 8A, there is printed a stave 8C which clearly indicates with musical notes, the pitches of the white keys and black keys of the scale display section 8A to be lit up.

Figure 2A:
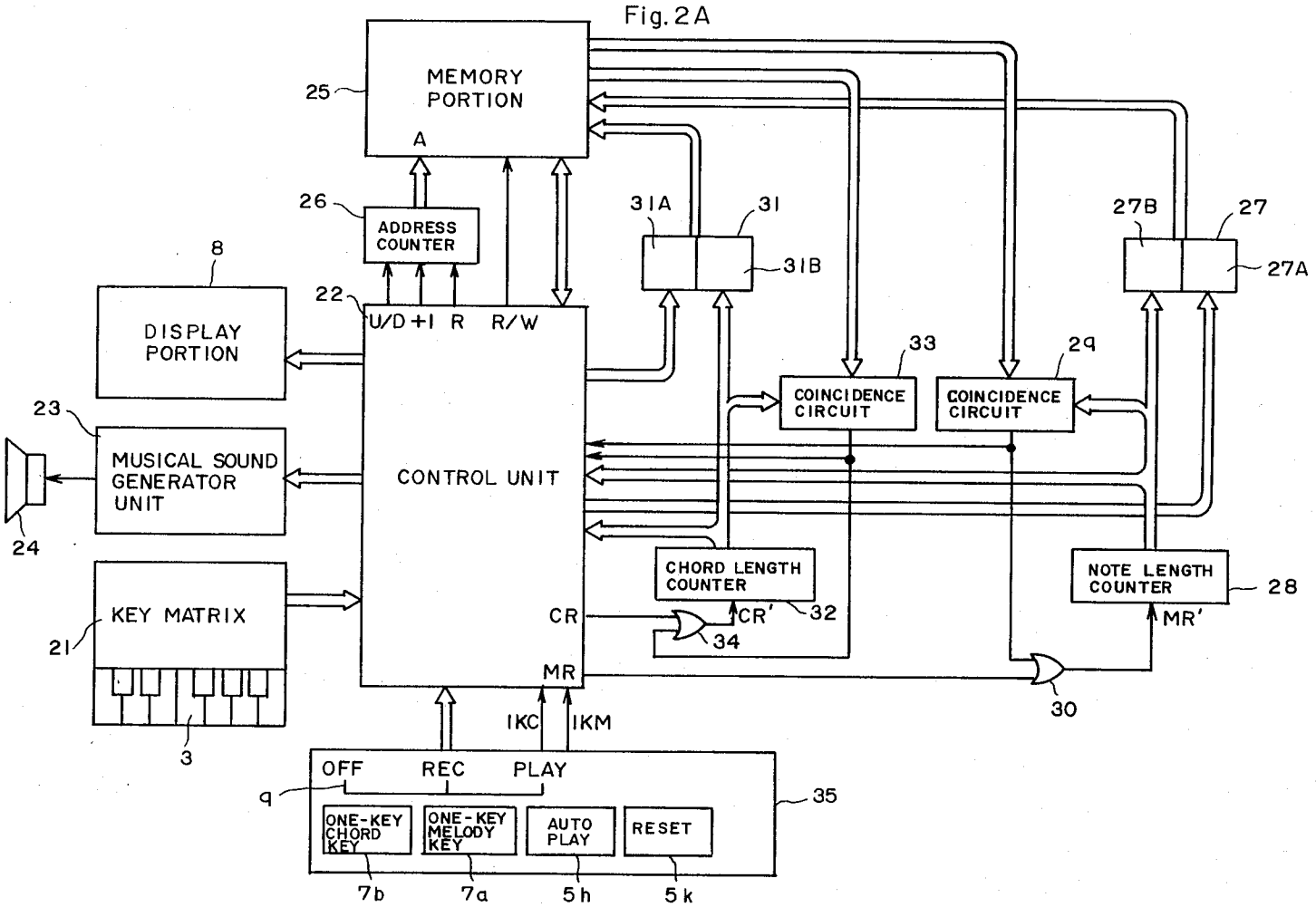
FIG. 2A is a block circuit diagram of the whole embodiment.

Referring now to FIG. 2A, the circuit arrangement of the whole automatic performance apparatus according to the present invention will be described.

As shown in the figure, the respective keys of the group of play keys 3 are connected to a key matrix circuit 21, and signals corresponding to the respective play keys are outputted from the key matrix circuit 21 to a control unit 22. The one-key melody key *7a*, one-key chord key *7b*, auto play key *5h*, reset key *5k*, mode change-over switch 9 and other keys are connected to a matrix circuit 35.

Here, for the sake of later description, the signal of the one-key melody key *7a* shall be denoted by "1KM", while the signal of the one-key chord key *7b* by "1KC". These signals 1KM and 1KC and the signals of the mode change-over switch 9 and other keys are outputted from the matrix circuit 35 to the control unit 22.

A musical sound generator unit 23 has its input side and output side connected to the control unit 22 and loudspeaker 24, respectively. It generates a musical sound on the basis of musical sound information and sound production command information received from the control unit 22, and amplifies it. The amplified output is delivered to the speaker 24 so as to actuate it. The information of the musical scale and chord of the musical sound thus produced are normally indicated by the display portion 8 connected to the control unit 22.

An address counter 26 has its input side and output side connected to the control unit 22 and memory portion 25, respectively. In order to appoint the address of the memory portion 25, the control unit 22 supplies the address counter 26 with an up/down signal (U/D) for determining countup or countdown, a variation signal (+1) and a reset signal (R). The address counter 26 increases or decreases its count value by a number specified by the up/down signal and the variation signals, and delivers the resultant value to the address input A of the memory portion 25. In addition, the control unit 22 is directly connected with the memory portion 25. Thus, a read/write control signal R/W for controlling the read/write operation of data is outputted from the control unit 22 to the memory portion 25, and the data is exchanged between the control unit 22 and the memory portion 25.

A register 27 for forming melody information is composed of a data register 27A for storing the information of the musical scale etc., and a note length register 27B for storing a note length. The input terminal of the data register 27A is connected to the control unit 22, while the input terminal of the note length register 27B is connected to the output terminal of a note length counter 28 and the control unit 22. The output terminal of the register 27 is connected to one input terminal of the memory portion 25, so that the melody information with the contents of both the data register 27A and the note length register 27B combined is written into the memory portion 25. The output terminal of the note length counter 28 is connected to one input terminal of a coincidence circuit 29 and the control unit 22, besides the note length register 27B referred to above. The other input terminal of the coincidence circuit 29 has one output terminal of the memory portion 25 connected thereto, and the output terminal thereof is connected to the control unit 22 and one input terminal of an OR gate 30. The other input terminal of the OR gate 30 is connected to the reset terminal MR of the control unit 22, and the output terminal thereof is connected to the reset terminal MR' of the note length counter 28.

A register 31 for forming chord information consists of a data register 31A for storing the information of a chord sort, a root, etc., and a chord length resister 31B for storing a chord length. The input terminal of the data register 31A is connected to the control unit 22, while the input terminal of the chord length register 31B is connected to the output terminal of a chord length counter 32 and the control unit 22. The output terminal of the register 31 is connected to the other input terminal of the memory portion 25, so that the chord information with the contents of both the data register 31A and the chord length register 31B combined is written into the memory portion 25. The output terminal of the chord length counter 32 is connected to the control unit 22 and one input terminal of a coincidence circuit 33. The other input terminal of the coincidence circuit 33 is connected with the other output terminal of the memory portion 25, and the output terminal thereof is connected to the control unit 22 and one input terminal of an OR gate 34. The other input terminal of the OR gate 34 is connected to the reset terminal CR of the control unit 22, and the output terminal thereof to the reset terminal CR' of the chord length counter 32.

The control unit 22 controls the operations of the whole circuitry of the present embodiment, and includes therein registers and counters for temporary storage.

In the circuit setup described above, the circuit arrangement and operations of the memory portion 25 will be described in detail later with reference to FIG. 2B, and those of the address counter 26 with reference to FIG. 2C.

Now, the operations of the present embodiment will be concretely described with reference to FIGS. 2A, 2B and 2C, FIGS. 3A and 3B, FIG. 4, FIGS. 5A and 5B, FIG. 6 and FIG. 7.

Figure 3A:
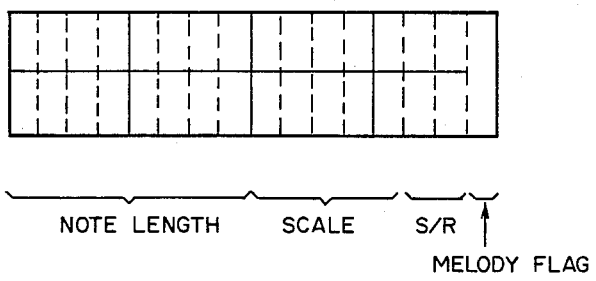
FIGS. 3A and 3B are diagrams of the recording formats of a melody and a chord which are stored in the memory portion, respectively.

FIG. 3A shows a format corresponding to one musical note of the melody information which is formed by the register 27 and which is written into the memory portion 25. The melody information has one note formed of 16 bits, which include 8 bits for the length of a note, 5 bits for the scale thereof, 2 bits for the ratio of the "on" time to the "off" time of a key corresponding to the note (S/R; sustain/release), and 1 bit for a melody flag for distinguishing the melody from the chord.

Figure 3B:
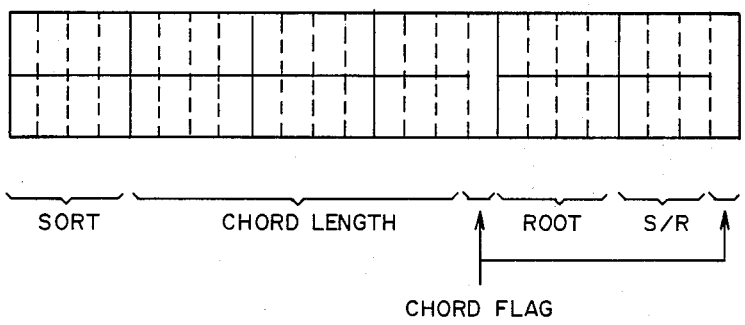

FIG. 3B shows a format corresponding to one chord of the chord information which is formed by the register 31 and which is written into the memory portion 25. The chord information has one chord formed of 24 bits, which includes 4 bits for a chord sort such as minor or seventh, 11 bits for the length of the chord, the next 1 bit and last 1 bit for chord flags, 4 bits for the root of the chord, and 3 bits for the S/R ratio of the chord. It is intended to prevent a malfunction in a read mode that the chord flags are provided in the two places.

FIG. 4 shows an example of 31 scale codes. These scale codes correspond to a case where the tone color of a piano is produced and where the tuning level is "O". Each of the scale codes is stored in those 5 bits of the foregoing melody information which correspond to the scale. Here, a dummy note whose scale code is all-"O" affords no melody information and merely signifies the beginning of a piece of music.

FIG. 5A shows 12 root codes. Each of these root codes is stored in those 4 bits of the foregoing chord information which correspond to the root.

FIG. 5B shows 9 sort codes. Each of these sort codes is stored in those 4 bits of the chord information which correspond to the chord sort.

The musical sound information are successively written into the memory portion 25 in accordance with the recording formats of the melody information and the chord information as described above.

FIG. 6 shows the musical score of "Camptown Races" composed by Foster. By taking this musical piece as a concrete example, circuit operations for writing the musical piece and for effecting the one-key play and automatic performance of the written musical piece will be described with reference to FIG. 2A.

First, in writing the musical piece, the mode changeover switch 9 is set at the position of a recording mode (REC). Which of the eight areas $M_1$–$M_8$ of the memory portion 25 the write is started from, can be selected by the memory key 5*a* and the eight black keys of the group of play keys 3 (which are shown in FIG. 1). Here, it is supposed that the first memory section $M_1$ is assigned. In this regard, however, the respective memory sections $M_1$–$M_8$ each having a capacity of 127 bytes are not separated functionally, but when the capacity of one memory section is exceeded, the next memory section is automatically written. In the ensuing description, accordingly, the distinction of these memory sections $M_1$–$M_8$ will not be especially referred to.

When the clear key 5*l* (FIG. 1) connected to the matrix circuit 35 is subsequently operated, a signal corresponding to this key is delivered to the control unit 22, which responds thereto to clear the content of the memory portion 25. Simultaneously therewith, the control unit 22 provides the reset signal R to reset the address counter 26, and produces the reset signals CR and MR. The signal CR is inputted to the OR gate 34, whereupon this OR gate provides the signal CR' to reset the chord length counter 32. The signal MR is inputted to the OR gate 30, whereupon this OR gate provides the signal MR' to reset the note length counter 28. At this stage, the dummy note is written in the head 2 bytes of the memory section of the memory portion 25 and indicates the beginning of the musical piece to be written henceforth. Further, the control unit 22 supplies the memory portion 25 with the R/W control signal of the write command, which holds the memory section of the memory portion 25 in a writable status.

Under such state, chords and melodies are inputted in the order of their progressions according to the musical score of FIG. 6 without regard to the lengths of notes and the tempo of the musical piece. That is, only the musical scales and chords are all written in advance, and the note lengths and chord lengths are thereafter determined. The apparatus is so constructed that, even at the stage of writing the scales and chords, note lengths and chord lengths based on actual key operations are tentatively stored. However, the operations of determining the note lengths and chord lengths will be briefly stated here, and they will be detailed later at the state of determining a note length with the one-key melody key *7a*.

When the play key corresponding to 1*a* ($A_5$) of the first sound is turned "on", a signal corresponding to the particular play key is delivered from the key matrix circuit 21 to the control unit 22. The control unit 22 decides that this signal is a melody signal, and supplies the data register 27A with the melody flag as well as the binary code (refer to FIG. 4) corresponding to the scale $A_5$. Besides, the note length counter 28 counts the "on" time and "off" time of the play key, and the control unit 22 calculates the note length and S/R value on the basis of both the values, to deliver the former to the note length register 27B and the latter to the data register 27A. When the melody information of the first sound have thus been formed in the register 27, the information of 2 bytes are written from the next address to the dummy note information previously stored in the memory section of the memory portion 25.

In view of the musical score of FIG. 6, information to be subsequently written is the first chord of D major. Since, in the present embodiment, a major chord is given merely by assigning a root, only a key $\boxed{D}$ in the group of chord assignment keys 4 is operated. In response to the key operation, the control unit 22 supplies the data register 31A with the sort (in this case, major) and root (in this case, D) of the chord, which are respectively expressed by the binary codes in FIGS. 5B and 5A, and the chord flags.

Further, the chord length counter 32 counts the "on" time and "off" time of the aforementioned key, and the control unit 22 calculates the chord length and S/R value on the basis of both the values, to deliver them to the chord length register 31B and data register 31A respectively. When the chord information of the first chord (D) have thus been formed in the register 31, the information of 3 bytes are sent to the memory portion 25 and written in the next address to the melody information of the first sound (1*a*).

Subsequently, 1*a* ($A_5$) of the second sound of the melody is inputted similarly to the foregoing, whereby the melody information thereof are stored in the next address to the first chord (D). Thenceforth, the play keys 3 and chord assignment keys 4 are similarly operated according to the progressions of the melodies and chords of the musical score, whereby the melody information each consisting of 2 bytes and the chord information each consisting of 3 bytes are serially written into the memory section of the memory portion 25.

Figure 7:
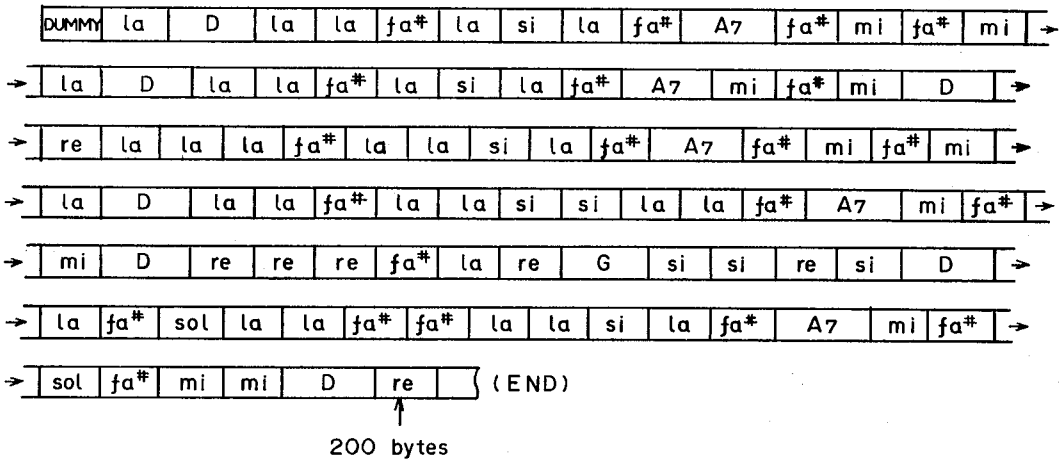
FIG. 7 is an arrayal diagram of the melody and chord information of the musical piece, "Camptown Races" recorded in the memory portion.

FIG. 7 shows in model-like fashion, the recorded state of the musical sound information of "Camptown Races" written in the memory sections of the memory portion 25 by the key operations described above. The melody information of the last sound are recorded in the 200th byte and 201st byte. As already described, each of the eight divided sections of the memory portion 25 has the capacity of 127 bytes. Therefore, the write has automatically proceeded from the memory section $M_1$ to the memory section $M_2$.

By the foregoing key operations, the musical scales of the notes and the sorts and roots of the chords have entirely been serially written in the order of the progressions. There will now be explained the operations of adding exact note lengths and chord lengths to the scales and chords of the respective notes by actuating the one-key melody key *7a* in accordance with the rhythm and tempo of "Camptown Races".

The reset key 5*k* is operated with the mode changeover switch 9 kept set at the position of the recording mode (REC). On the basis of a signal provided from the matrix circuit 35 at that time, the control unit 22 delivers the reset signal R to the address counter 26 so as to reset this counter.

When the one-key melody key *7a* is subsequently turned "on" (first time), the signal 1KM is delivered from the matrix circuit 35 to the control unit 22. Upon receiving this signal 1KM, the control unit 22 supplies the address counter 26 with the U/D signal of countup and the variation signal +1 twice. Since the address counter 26 advances the address by 1 byte by receiving the variation signal +1 once, it advances the address by 2 bytes, namely, in correspondence with the dummy note indicating the head of the musical piece by receiving this signal twice as described above. In addition, the control unit 22 supplies the memory portion 25 with the R/W control signal of read. Then, while outputting the variation signal, the control unit 22 reads out the content of the memory section of the memory portion 25 every byte, and it continues the read until the melody flag or chord flag is found out at the final bit of such one byte. Since, in the current case, the melody information of 1*a* ($A_5$) of the first sound are stored next to the dummy note, the control unit 22 reads out the melody information of 2 bytes. Upon deciding that the information read out are the melody information, the control unit 22 supplies the address counter 26 with the U/D signal of countdown and the variation signal +1 once so as to restore the original address. Further, the control unit 22 delivers the reset signal MR to the OR gate 30, the output MR' of which resets the note length counter 28 and causes it to start counting. Yet further, the control unit 22 delivers the respective data of the scale, S/R value and melody flag among the read melody information to the data register 27A so as to temporarily store them therein and also delivers the scale data to the musical sound generator unit 23 and the display portion 8. While the one-key melody key *7a* is held "on" the musical sound generator unit 23 produces the musical sound of the particular scale in accordance with the inputted scale data and preset tone color information, and the display portion 8 indicates the scale being produced. During the "on" period of the one-key melody key *7a*, the note length counter 28 continues counting, and the count value is kept applied to the control unit 22.

When the one-key melody key *7a* is turned "off", the control unit 22 delivers the reset signal MR to the OR gate 30, thereby to reset the note length counter 28. Simultaneously, the count value of the note length counter 28 counted till then is temporarily stored as the "on" time in a register disposed within the control unit 22. The reset note length counter 28 now begins to count the "off" time of the one-key melody key *7a*. In addition, the musical sound generator unit 23 stops the production of the musical sound, and the display portion 8 stops the indication of the scale.

When the length of 1*a* ($A_5$) of the first sound or a period of time corresponding to the eighth note in the current case has thus lapsed since the turn-on of the one-key melody key *7a*, this one-key melody key ought to be turned "on" again.

When the one-key melody key *7a* is turned "on" again (second time), the control unit 22 delivers the reset signal MR to the OR gate 30 so as to reset the note length counter 28. Simultaneously, the count value till that time is stored as the "off" time in a register disposed within the control unit 22. On the basis of the count value of the "on" time already stored and the count value of the "off" time stored this time, there are calculated the note length which is the sum of both the count values and the S/R value which is the ratio of the "on" time to the "off" time. The S/R value is supplied to the data register 27A, and the note length to the note length register 27B. In this way, the S/R value which is the proportion between the "on" time and "off" time of the key of one note is stored in the register 27 along with the exact note length, so that the correct melody information of the first sound are formed.

Subsequently, the control unit 22 supplies the memory portion 25 with the R/W control signal of write to bring the memory section thereof into a writable status. While causing the address counter 26 to count up, the control unit 22 writes byte by byte, the exact melody information of the first sound formed in the register 27 into 2 bytes from the address which is appointed by the address counter 26 at that time, that is, into the area in which the melody information of the first sound have originally been stored.

At the same time that the above write processing has ended, the address counter 26 appoints the next address in accordance with a command from the control unit 22, whereupon similarly to the above, the control unit 22 reads out data from the memory portion 25 every byte and continuous the reading until the melody flag or chord flag is found out. In the current case, the chord flag is found out, and one more byte is thereafter read out. Thus, the 3 bytes of the chord information are fetched in the control unit 22. In the case where the information read out are the chord information, the control unit 22 temporarily stores the head address of the 3 bytes in which the chord information have been stored. The reason is that the chord length cannot be imparted to the first chord information unless the second chord information have been read out. Since, in the current case, the first chord is concerned, the write processing of the chord length is not executed. Further, the control unit 22 reads out the chord sort (in this case, major) and root (in case case, D) in the chord information and outputs them to the musical sound generator unit 23 as well as the display portion 8. The generation and display of the musical sound are continued until the second chord is read out.

Subsequently to the above processing, the control unit 22 executes the read control as already stated and reads out the melody information of 1*a* ($A_5$) of the second sound stored next the chord information of the first chord (D).

When, after turning "off" the one-key melody key 7*a*, it has been turned "on" (third time), a note length and S/R value in the melody information of the second sound are determined and added, and the exact melody information are written into the memory section of the memory portion 25 again. Further, since the melody information succeeds the first chord information, the note length is stored in the register, not shown, within the control unit 22 in order to calculate the chord length of the first chord, and it is added with the note lengths of the respective notes before the second chord. The number of bytes corresponding to the number of melody information in the meantime is being counted by a melody data counter, not shown, within the control unit 22. Thenceforth, each time the one-key melody key 7*a* is turned "on", a correct note length and S/R value are imparted to the melody information, the next melody information are read out, and the melody data counter is incremented by +2. Moreover, such note lengths are accumulated.

At the point of time at which the one-key melody key 7*a* has been turned "on" at the ninth time, the note length and S/R value of fa ($F_5^{\#}$) of the melody information are determined, and simultaneously, the chord information of the second chord ($A_7$) are read out. The control unit 22 stores the address of the chord information and decides whether or not the chord information are of the first chord. Since, in the current case, the second chord is concerned, the control unit 22 executes the processing of determining the chord length of the first chord.

As already stated, the chord length of the first chord has been stored in the register within the control unit 22 at the point of time of the read of the second chord. Therefore, the control unit 22 causes the address counter 26 to count down by the count value of the melody data counter. It reads out the 3 bytes of the chord information of the first chord from the memory portion 25, writes the correct chord length with 11 bits, and gives the exact chord information back to the memory portion 25 again.

In the way thus far described, the chord length of the first chord is determined and imparted. Thenceforth, the note lengths and S/R values of melody information and the chord lengths of chord information are similarly determined through the "on" and "off" operations of the one-key melody key 7*a*.

In the foregoing way, the respective information of the melodies and chords have been written in the memory portion 25. In the next place, circuit operations at the execution of the one-key play will be described.

First, the mode change-over switch 9 is set at a play mode (PLAY). In the play mode, the note length data etc. having been set cannot be rewritten because the R/W control signal supplied from the control unit 22 to the memory portion 25 is "read". Next, the address counter 26 is reset by operating the reset key 5*k*.

When the one-key melody key 7*a* is turned "on", the address counter 26 is incremented by +2, and the melody information of 1*a* ($A_5$) of the first sound following the dummy note of 2 bytes are read out. Since the controls of the address counter 26 and memory portion 25 by the control unit 22 have already been explained, they shall be omitted in the following. Upon reading the melody information of the first sound, the control unit 22 delivers the musical scale information to the musical sound generator unit 23 and display portion 8. The musical sound generator unit 23 produces the musical sound of 1*a* ($A_5$), which is emitted from the loudspeaker 24. When the one-key melody key 7*a* is turned "off", the emission of 1*a* ($A_5$) of the first sound falls into the release state and stops. When the one-key melody key 7*a* is subsequently turned "on", the chord information of the first chord (D major) are fetched from the memory portion 25 into the control unit 22. Upon deciding that the fetched information are the chord information, the control unit 22 supplies the musical sound generator unit 23 and display portion 8 with the chord sort (in this case, major) and root (in this case, D) thereof, and the musical sound of the chord D major is emitted. At the same time, the control unit 22 increments the address counter 26 by +1 in succession. It reads out the melody information of 1*a* ($A_5$) of the second sound, and emits the sound through the musical sound generator unit 23 likewise to the case of the first sound. Accordingly, the chord of D major and the sound of 1*a* ($A_5$) start being emitted simultaneously.

Thenceforth, musical sound information are successively read out and emitted as sounds through the similar operations of the one-key melody key 7*a*.

Next, the case of executing the perfect automatic performance will be described. With the mode change-over switch 9 set at "PLAY", the reset key 5*k* is turned "on" to reset the address counter 26, note length counter 28 and chord length counter 32.

When the auto play key 5*h* is subsequently turned "on" once, the control unit 22 reads out the melody information of 1*a* ($A_5$) of the first sound from the memory portion 25, to deliver the musical scale data thereof to the musical sound generator unit 23 and display portion , and it also causes the memory portion 25 to supply the coincidence circuit 29 with the note length data of the melody information of the first sound. Simultaneously, the note length counter 28 starts counting. Further, the control unit 22 calculates the emission period of time of the musical sound on the basis of the value of S/R and note length data in the melody information of the first sound. Upon lapse of the emission period of time, the control unit 22 supplies the musical sound generator unit 23 with a control signal to bring the musical sound into the release state and stop it. Meantime, the note length counter 28 continues counting, and when its count value has coincided with the note length data stored in the coincidence circuit 29, this coincidence circuit delivers a coincidence signal to the control unit 22 and OR gate 30. Then, the OR gate 30 delivers the reset signal MR′ to the note length counter 28 to reset it. Also, the control unit 22 having received the coincidence signal increments the address counter 26 so as to read out the 3 bytes of the chord information of the first chord (D major). Chord sort data and root data in the chord information are delivered to the musical sound generator unit 23 and emitted as a sound by the speaker 24, while chord length data is delivered from the memory portion 25 to the coincidence circuit 33 and stored temporarily. Simultaneously, the control unit 22 increments the address counter 26 so as to read out the melody information of 1*a* ($A_5$) of the second sound. Musical scale data in the melody information is delivered to the musical sound generator unit 23 and emitted as a sound by the speaker 24, while note length data is delivered from the memory portion 25 to the coincidence circuit 29 and stored therein. The note length counter 28 and chord length counter 32 start counting, and continue the counting until their contents coincide with the values in the respective coincidence circuits 29 and 33. Accordingly, the musical sounds of the chord of D major and 1*a* ($A_5$) of the second sound are simultaneously emitted from the speaker 24 through the musical sound generator unit 23.

Thenceforth, while the chord of D major is being emitted, the second to eighth sounds of the melody are read out upon lapse of the respective note length periods and emitted. When the count value of the chord length counter 32 has coincided with the value in the coincidence circuit 33, that is, when the chord length period of the first chord has lapsed, the coincidence circuit 33 delivers a coincidence signal to the control unit 22 and OR gate 34. Simultaneously, the OR gate 34 provides the reset signal CR′ to reset the chord length counter 32. Further, upon receiving the coincidence signal, the control unit 22 increments the address counter 26 so as to read out the chord information of teh second chord $A_7$. Likewise to the case of the first chord, chord length data in the chord information is delivered to the coincidence circuit 33, and the chord length counter 32 starts counting. Substantially simultaneously, the coincidence circuit 29 provides a coincidence signal at the end of the emission of the eighth sound of the melody, and the melody information of the ninth sound are read out. Accordingly, the sound of the second chord and the ninth sound of the melody are simultaneously emitted. Thence forth, the circuits operate similarly to the above, and the automatic performance is executed.

Figure 2B:
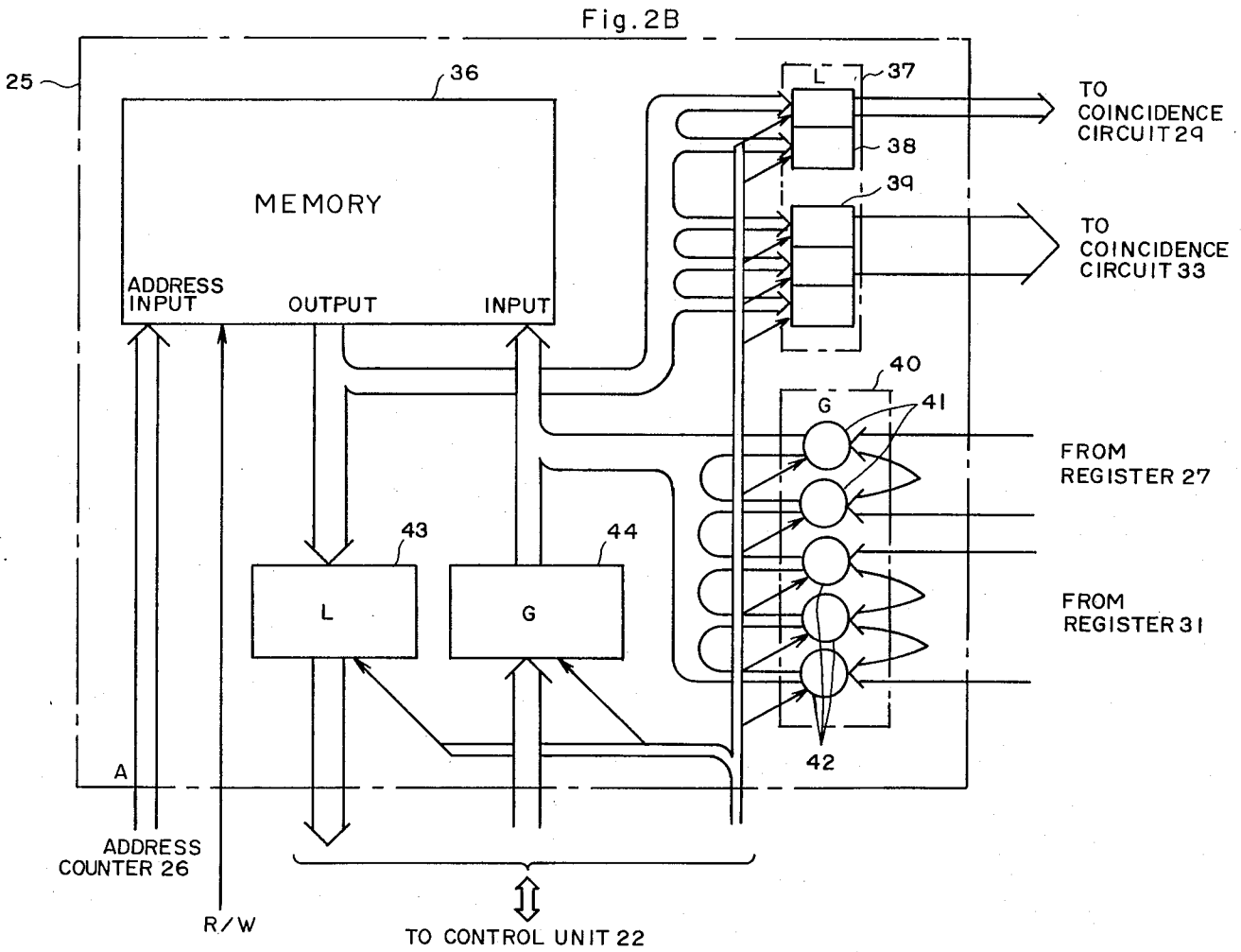
FIG. 2B is a block circuit diagram of a memory portion in FIG. 2A.
Figure 2C:
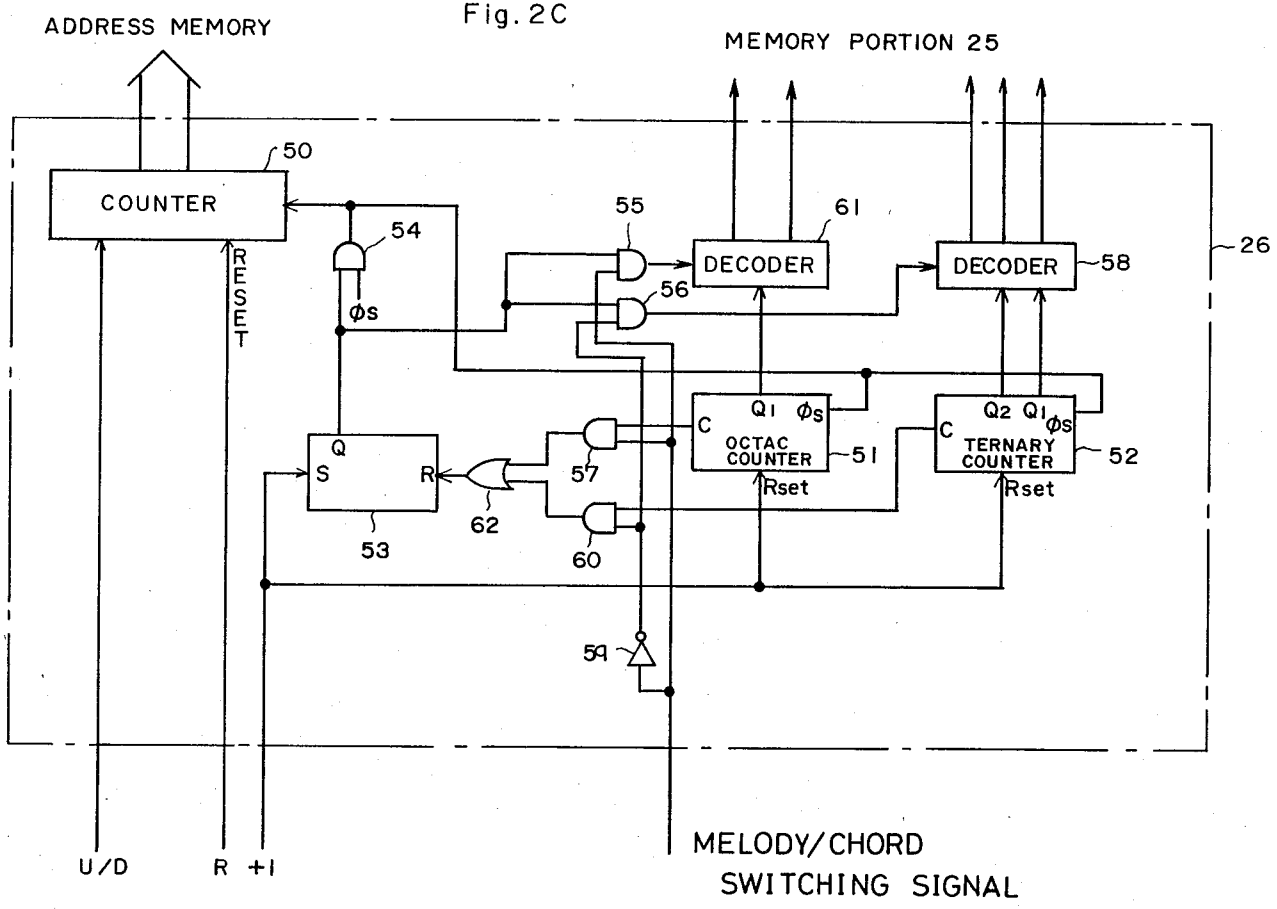
FIG. 2C is a block circuit diagram of an address counter in FIG. 2A.

Next, it is further explained in detail how respective melody and chord information are written in or read out from the memory 25 by referring to FIG. 2B.

FIG. 2B is a detailed circuit arrangement diagram of the memory portion 25 in FIG. 2A.

A memory 36 is accessed in byte unit by receiving the address from the address counter 26. Accordingly, the melody information is composed of 2 bytes, and the chord information is composed of 3 bytes. Further, the memory 36 receives the read/write control signal R/W from the control unit 22. Besides, it delivers data to the control unit 22 through a latch circuit 43 and receives data from the control unit 22 through a gate circuit 44 In addition, the output data of the memory 36 are applied to the coincidence circuits 29 and 33 through a latch circuit 37, and the input data thereof are applied from the registers 27 and 31 through a gate circuit 40. The latch timings of the latch circuits 37 and 43 and the enabling and disabling timings of the gate circuits 40 and 44 are set by control signals from the control unit 22. The three buses of a data bus for the output from the latch circuit 43, a data bus for the input to the gate circuit 44, and a control bus for the inputs to the latch circuits 37, 43 and gate circuits 41, 44 are depicted as a bidirectional bus coupling the control unit 22 and the memory portion 25, in FIG. 2A.

Operations in the case of inputting the melody information and chord information from the respective registers 27 and 31 to the memory 36 will be explained below.

The melody information of the register 27 is composed of 2 bytes, and the chord information of the register 31 is composed of 3 bytes. First, let's consider a case where gates 41 are supplied with inputs from the register 27 and where the 2 bytes of the information are stored into the memory 36 from Address 1 thereof.

Address 1 is appointed by the address counter 26, and the R/W control signal for write is applied from the control unit 22 to the memory 36. By the gate control signal applied from the control unit 22, the upper gate 41 is first turned "on", so that 1 byte of the first half of the information of the register 27 is inputted to the memory 36 and stored in Address 1 appointed. Then, the upper gate 41 is turned "off" by the control signal, whereupon Address 2 is appointed by the output of the address counter 26. This time, the lower gate 41 is turned "on", so that 1 byte of the latter half of the information of the register 27 is inputted to Address 2.

Subsequently, when the chord information is applied from the register 31 to gates 42, the address counter 26 is incremented to appoint Address 3 of the memory 36, and the upper gate 42 is turned "on" to store the first one byte in Address 3. Further, the address counter 26 is successively incremented, and the middle and lower gates 42 are turned "on" in conformity with the timings, whereby the second byte and third byte of the information of the register 31 are respectively stored in Address 4 and Address 5. In this way, the melody information and chord information are serially stored by the control signals from the control unit 22.

Secondly, there will be explained a case where the content of the memory 36 is supplied to the coincidence circuits 29 and 33. As already stated, the note length data has been stored in the 1st to 8th bits, and the chord length data in the 5th to 15th bits. Accordingly, information corresponding to 1 byte of the first half from an upper latch circuit 38 may be taken as the output to the coincidence circuit 29. In addition, the 5th to 15th bits from latch circuits 39 may be taken as the output to the coincidence circuit 33. The latch timing control is similar to the gate control, and the information may be latched at the same timing that the address counter 26 is incremented using the R/W signal as the read command.

The latch circuit 43 is the same as the latch circuit 37, and the gate circuit 44 is the same as that 40. The timing controls are similarly executed.

As described above, a timing control of the gate and latch circuit as well as an address designating timing control are conducted by the control unit 22. It is also possible to control the timing of the gate and latch circuit by a circuit provided with the address counter 26.

Next, the address counter 26 will be described by referring to FIG. 2C which is a detailed circuit arrangement diagram thereof. A counter 50 is supplied with the up/down signal U/D and the reset signal R from the control unit 22. The variation signal +1 from the control unit 22 is applied to the respective reset terminals of a binary counter 51 and a ternary counter 52 and also the set terminal of a set-reset flip-flop 53. The output Q of the set-reset flip-flop 53 is connected to one input terminal of an AND gate 54, the other input terminal of which is supplied with a basic clock $\phi_s$. Further, the output Q of the set-reset flip-flop 53 is connected to AND gates 55 and 56. A melody/chord change-over signal is applied to an AND gate 57, and is also applied to the enable terminal of a decoder 58 through the AND gate 56. In addition, the melody/chord change-over signal is applied to an inverter 59, the output of which is applied to an AND gate 60 and also to the enabe terminal of a decoder 61 through the AND gate 55. The output of the AND gate 54 is applied to the respective clock input erminals of the counter 50, binary counter 51 and ternary counter 52. The output $Q_1$ of the binary counter 51 is connected to the decode input terminal of the decoder 61, and the outputs $Q_1$ and $Q_2$ of the ternary counter 52 are oonnected to the decode input terminals of the decoder 58. The carry outputs of the binary counter 51 and ternary counter 52 are respectively applied to an OR gate 62 through the AND gates 57 and 60. The output of the OR gate 62 is connected to the reset terminal of the set-reset flip-flop 53. The outputs of the decoders 58 and 61 are applied to the gate circuits 40, 44 and latch circuits 37, 43 of the memory portion 25 shown in FIG. 2B.

In accordance with the variation signal +1, up/down signal U/D and melody/chord change-over signal which are inputted from the control unit 22, the address counter 26 stores the input data or reads out the data stored in the memory portion in, for example, 8-bit unit. In writing or reading the data into or from the memory portion 25, the melody/chord change-over signal is first applied from the control unit 22 so as to appoint the storage of either the melody data or the chord data. The variation signal +1 is subsequently inputted to bring the set-reset flip-flop 53 into the set status and to reset the binary counter 51 and ternary counter 52. Upon the setting of the set-reset counter 53, a high level is applied to one input of the AND gate 54, with the result that the basic clock $\phi_s$ is delivered from the AND gate 54. Thus, the counter 50, binary counter 51 and ternary counter 52 are supplied with the basic clock $\phi_s$, and they are incremented. The numbers of increments of the counters are determined by the melody/chord change-over signal. When the melody/chord change-over signal is at its high level, the operation of storing or reading the melody data is executed. More specifically, at this time, all the counters are incremented until the AND gate 57 is turned "on" to apply the carry output of the binary counter 51 to the reset terminal R of the set-reset flip-flop 53 through the AND gate 57 and OR gate 62 so as to reset the flip-flop 53. In other words, the counter 50 has its count value increased by +2. (This operation corresponds to the "up" mode, and the count value decreases in the "down" mode.) When the melody/chord change-over signal is at its low level, the AND gate 60 is turned "on", and the carry output of the ternary counter 52 resets the set-reset flip-flop 53 through the AND gate 60 and OR gate 62. At this time, the counter 50 has its count value increased by +3. (The count value decreases in the "down" mode.)

Owing to the above operation, each time the variation signal +1 is inputted, the counter 50 is incremented (or decremented) by +2 or +3. Meantime, the memory portion 25 is addressed to write or read the data. When the melody/chord change-over signal is at the high level and data is to be written, the address counter 26 operates so as to select the melody data. More specifically, the AND gate 55 is turned "on" by the melody/chord change-over signal, and the output of the set-reset flip-flop 53 is applied through this AND gate 55 to the enable terminal of the decoder 61, which decodes the output of the binary counter 51. Thus, the gates 41 in FIG. 2B are turned "on" in correspondence with the binary counter value (the same applies to the gates 44), and the data is fed to the memory 36 in 8-bit unit and written therein with a clock synchronized to the basic clock $\phi_s$. When the melody/chord change-over signal is at its low level and data is to be written, the chord data is selected. More specifically, since the melody/chord change-over signal is applied to the AND gate 56 through the inverter 59, the AND gate 56 is turned "on", and the output of the set-reset flip-flop 53 is applied through the AND gate 56 to the enable terminal of the decoder 58, which decodes the output of the ternary counter 52. Thus, the gates 42 in FIG. 2B corresponding to the ternary counter value are successively turned "on" (the same applies to the gates 44), and the data is fed to the memory 36 in 8-bit unit. It is written with a clock synchronized to the basic clock. While, in the above, the write of data into the memory has been explained, the read is similar. In the reading operation, the latches 37 and 43 are selectively operated likewise to the gates stated above, and data stored in a desired address is fed into the latches 37, 43 and is delivered to the coincidence circuits 29, 33 and the control unit 22.

The "down" mode of the address counter 26 is an operation for partial revision in writing or replaying the chord data, and it merely decreases the counter value. During this operation, the memory 36 is held in the read status by the control unit 22.

Figure 8:
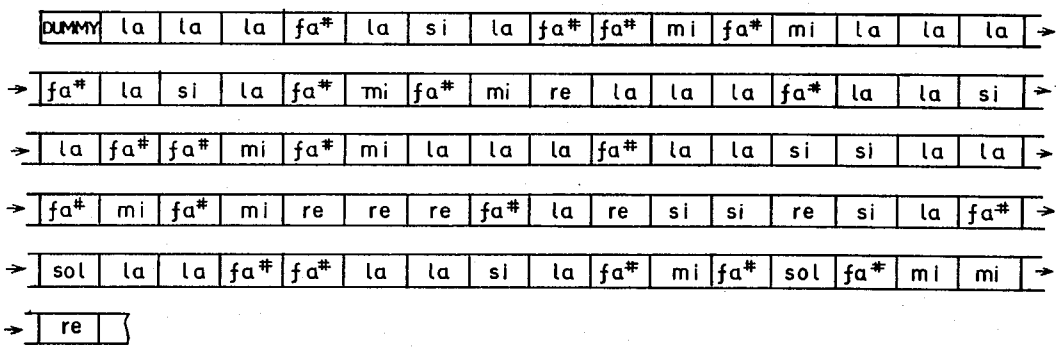
FIG. 8 is an arrayal diagram of the melody information of the musical piece recorded in the memory portion prior to the chord information.

Owing to the operations thus far described, in spite of unequal quantities of data, the melody and chord data are respectively written in the melody data and chord data units by successively inputting the variation signals, whereby the data are continuously stored into the memory 36. Also in reading the data, they can be similarly read out from the memory in succession. Thus, an unused part in the memory 36 does not exist in data unit, and the efficient use of the memory becomes possible FIG. 8 shows the state in which only the melodic progression of "Camptown Races" has been inputted to the memory portion 25 in advance. After the melodic progression has been inputted as shown in the figure in the "REC" mode, the address of the memory portion to be written is returned to Address zero. While the malodies are being successively advanced with the one-key melody key *7a*, the group of chord assignment keys 4 are operated in necessary places so as to insert the corresponding chords therein. Then, the state of FIG. 7 can be established. In this case, when any chord assignment key 4 is operated in a certain address place in the memory section in which the melody data are contained, all the musical sound information of the melody are shifted backwards by 3 bytes so as to form an empty area. Subsequently, the musical sound information of a chord except the note length thereof are inputted to the empty area. Subsequently, the one-key melody key *7a* is operated a plurality of times so as to increment the address counter 26 to an area into which the next chord is to be inserted. Thereafter, any chord assignment key 4 is operated again. When, in this manner, the musical sound information except the note lengths have been inputted for all the chords, the beginning of the musical piece is called, whereupon the note lengths are inputted in such a way that the one-key melody key *7a* is turned "on" for the note length periods of the respective melodies similarly to the above.

Figure 9:
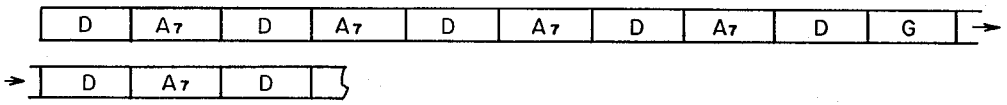
FIG. 9 is an arrayal diagram of the chord information of the musical piece recorded in the memory portion prior to the melody information.

FIG. 9 shows the state in which, conversely to the case of FIG. 8, the chordal progression of "Camptown Races" have been set in the memory portion 25 beforehand. After the setting, the musical sound of the group of play keys 3 is inserted while the musical sound information of the chords are being shifted by operating the one-key chord key *7b*. Then, the state of FIG. 7 can be established. In this case, each time the musical sound information of the melody are inserted, those of the chords are shifted backwards by 2 bytes.

Figure 10:
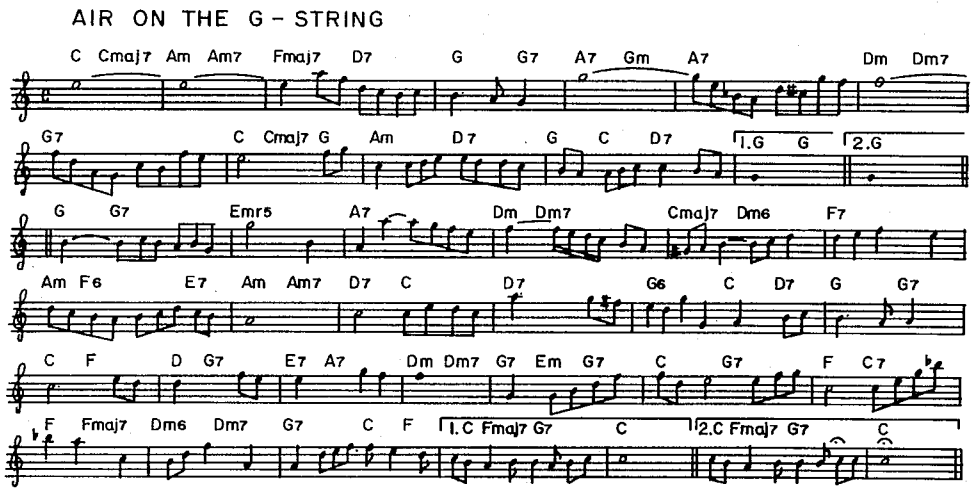
FIG. 10 is a diagram showing the musical score of "Air on the G-string"
Figure 11:
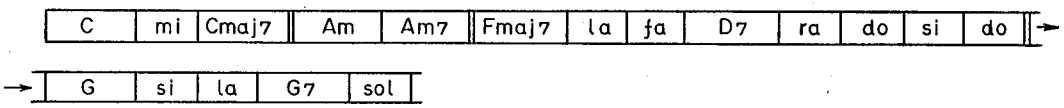
FIG. 11 is an arrayal diagram showing parts of the melody and chord information of the musical piece, "Air on the G-string" recorded in the memory portion.
Figure 12:
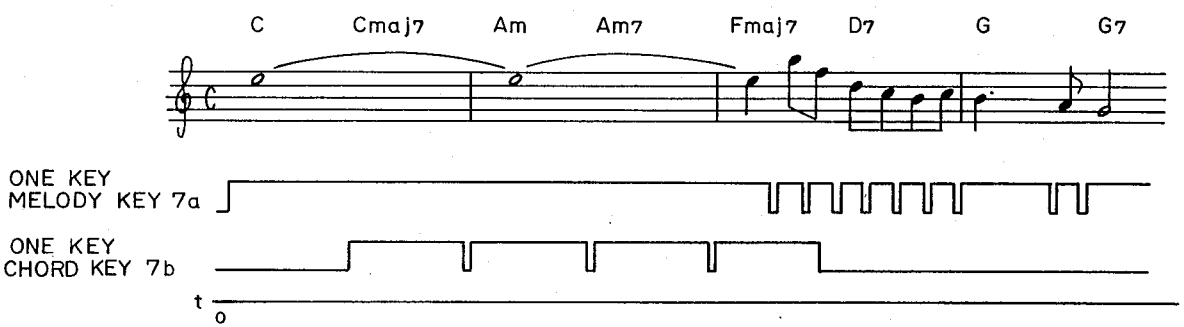
FIG. 12 is a timing chart showing the timings of key operations for executing the one-key play of the musical piece.

FIG. 10 is a diagram showing the musical score of "Air on the G-string" composed by J. S. Bach. As to this musical piece, in the beginning two measures, a plurality of chordal sounds are imparted to a single melodic sound. Even in case of such musical piece, the respective musical sound information of melodies and chords can be written into the memory portion 25 quite similarly to the case of the foregoing embodiment. FIG. 11 shows the recorded state in model-like fashion. In case of executing the one-key play by operating the one-key melody key *7a* and one-key chord key *7b*, the key operation states become as illustrated in FIG. 12.

When the one-key melody key *7a* is turned "on" at the beginning of the musical piece, the first chord C is read out along with the first sound mi ($E_6$), and they are simultaneously emitted, as already described. Subsequently, with the one-key melody key *7a* kept "on", the one-key chord key *7b* is turned "on" midway of the first measure. Since, in this case, the one-key melody key *7a* is held "on", the note length counter 28 for counting the note length of the first sound mi ($E_6$) continues counting. Thus, when the one-key chord key *7b* is turned "on", the control unit 22 supplies the OR gate 34 with the reset signal CR to reset the chord length counter 32, and simultaneously, the address counter 26 is incremented to fetch the next information, namely, the second chord $C_{maj7}$ into the control unit 22, the chord length counter 32 starting to count the chord length thereof. At this point of time, the chord length of the first chord C is determined and added to the chord information, and the resultant chord information are fed back to the memory portion 25. The second chord $C_{maj7}$ is emitted along with the first sound mi ($E_6$). When, after the one-key chord key *7b* has been turned "off", it is subsequently turned "on" at the beginning of the second measure, the chord length of the second chord is determined, and the third chord $A_m$ is read out and emitted along with the first sound mi ($E_6$).

That is, the first sound mi ($E_6$) of the melody is produced while the first to fifth chords change in succession. Subsequently, the one-key melody key *7a* is turned "off" later than the note length period of a quarter note after the beginning of the third measure. Subsequently, this key *7a* is turned "on" and "off" each time the note length period of one eighth note lapses, as illustrated in FIG. 12. The one-key chord key *7b* is turned "off" midway of the third measure, and is followed by the turn-on of the one-key melody key *7a*. Therefore, the fourth sound re ($D_6$) in the third measure of the melody and the chord $D_7$ are simultaneously read out and started to be emitted. Thereafter, in the third and fourth measures in FIG. 12, one or more melodic sounds correspond to one chordal sound, so that each chord is read out along with the corresponding melodic sound or sounds at the operation of the one-key melody key *7a*. In a part wher only chords change without any melodic change as stated above, the one-key chord key *7b* is similarly operated. Thus, the performance can be perfectly conducted throughout the musical piece.

While, in the foregoing embodiment, various key input devices have been used as means for inputting musical sound information into a memory, the invention is not restricted thereto but may well employ other various input means such as a bar code reader, a magnetic reader, an optical reader adapted to directly read a musical score, and a voice input system.

While the embodiment has exemplified the case of applying this invention to a portable automatic performance apparatus, the invention may well be incorporated into a large-sized electronic keyboard musical instrument of the console type, a music synthesizer, etc. The apparatus of the present invention can be provided, not only as a straightforward equipment, but also as one of the functions of a small-sized equipment, e. g., a programable small-sized electronic computer or a personal computer.

What is claimed is:

1. An automatic performance apparatus comprising:
input means for inputting musical sound information of a musical piece which includes melodic musical sound information corresponding to a melody of said musical piece and chordal musical sound information corresponding to a chord to be added to the melody, in accordance with a progression of said musical piece;

storage means coupled to said input means and having, in a single memory area, a plurality of memory locations, each of said memory locations selectively storing said melodic sound information and said chordal musical sound information corresponding to a chord to be added to the melody, said melodic and chordal musical sound information being inputted by said input means, the storing order of the melodic musical sound information and of the chordal musical sound information in said plurality of memory locations being determined by the musical piece to be stored, said melodic musical sound information stored in a given memory location including at least note pitch code data and note length code data, and said chordal musical sound information stored in a given memory location including at least chord name code data and chord length code data;

reading means coupled to said storage means for successively and sequentially reading out the musical sound information stored in said memory locations of said storage means, said reading means including a single address designation means for sequentially designating addresses of memory locations in said single storage means from which said musical sound information is to be read out; and musical sound producing means coupled to said reading means for producing musical sounds corresponding to the melody and chord based on the musical sound information successively read out by said reading means.

2. An automatic performance apparatus according to claim 1, wherein said reading means includes an automatic reproduction directing means for directing the automatic reproduction of musical sound information stored in said storage means.

3. An automatic performance apparatus according to claim 1, wherein said reading means reads out the musical sound information stored in said storage means, in accordance with a melodic progression.

4. An automatic performance apparatus according to claim 1, wherein the melodic musical sound information further includes ratio code data corresponding to sustain/release.

5. An automatic performance apparatus according to claim 4, wherein the note pitch code data includes a dummy code which expresses a beginning of the musical piece.

6. An automatic performance apparatus according to claim 1, wherein the chordal musical sound information further includes ratio code data corresponding to sustain/release.

7. An automatic performance apparatus according to claim 1, wherein said reading means includes a one-key melody key, and a control means for reading out said chordal musical sound information together with said melodic musical sound information corresponding to operations of said one-key melody key.

8. An automatic performance apparatus according to claim 1, wherein said reading means includes a one-key play key, and wherein a melody and a corresponding chord are stored in successive memory locations of said storage means, said single address designation means causing said chord and following melody to be read out sequentially from said storage means responsive to operation of said one-key play key.

9. An automatic performance apparatus according to claim 1, wherein said reading means includes a one-key melody key, a one-key chord key, and a control means for reading out said chordal musical sound information together with a melody in correspondence with the operations of said one-key melody key, and for reading out said chordal musical sound information together with a melody in correspondence with the operations of said one-key chord key.

10. An automatic performance apparatus, comprising:

memory means having, in a single memory area, a plurality of memory locations having respective addresses, each of said memory locations selectively storing melodic musical sound information corresponding to a melody and chordal musical sound information corresponding to a chord to be added to the melody, the storing order of the melodic musical sound information and the chordal musical sound information in the plurality of storage locations being determined by the musical piece to be stored;

said melodic musical sound information stored in a given storage location including at least note pitch code data and note length code data, and said chordal musical sound information stored in a given storage location including at least chord name code data and chord length code data;

a selectively operable one-key melody key for causing performance of a melody;

a selectively operable one-key chord key for causing performance of a chord;

a single address designation means coupled to said memory means and including first means means for changing the address of said memory locations responsive to each operation of the one-key melody key to successively read out the melodic musical means; and second means for changing the address of said memory locations responsive to each operation of the one-key chord key to successively read out the chordal musical sound information from respective memory locations of said memory means; and musical sound producing means coupled to said single address designation means for producing musical sounds of the melody and/or chord based on the melodic and/or chordal musical sound information successively read out from said memory means responsive to operation of said one-key melody key and/or said one-key chord key.

11. An automatic performance apparatus according to claim 10, further comprising:

a mode setting means for setting a play mode or a recording mode; and a directing means for directing not to change the note length code data and the chord length code data stored in said memory means when the one-key melody key and the one-key chord key are operated in said play mode set by said mode setting means, and for directing to rewrite the note length code data and the chord length code data stored in said memory means when said one-key melody key and said one-key chord key are operated in said recording mode set by said mode setting means.

12. An automatic performance apparatus according to claim 10, wherein a melody and a corresponding chord are stored in successive memory locations of said memory means, said single address designation means causing said chord and following melody to be read out sequentially from said memory means responsive to operation of said one-key melody key.

13. An automatic performance apparatus comprising:

memroy means having in a single memory area, a plurality of memory locations for storing in given memory locations melodic musical sound information corresponding to a melody of a musical piece and chordal musical sound information corresponding to a chord to be added to the melody, the storing order of the melodic musical sound information and the chordal musical sound information in the plurality of memory locations being determined by the musical piece to be stored;

a selectively operable one-key melody key for causing perfomance of at least a melody;

a selectively operable one-key chord key for causing performance of a chord;

first address designation means coupled to said memory means and including first means responsive to operations of said one-key melody key for sequentially reading out the melodic musical sound information and incidental chordal musical sound information corresponding thereto from a memory location of said memory means when said one-key melody key is operated; and second means responsive to operations of said one-key chord key for reading out the chordal musical sound information which is successively stored in a memory location of said memory means when said one-key chord key is successively and continuously operated; and musical sound producing means coupled to said single address designation means for producing musical sounds of the the melody and/or chord based on the melodic and/or chordal musical sound information successively read out from said memory means responsive to operation of said one-key melody key and/or said one-key chord key.

14. An automatic performance apparatus according to claim 13, wherein said melodic musical sound information includes at least note pitch code data and note length code data, and said chordal musical sound information includes at least name code data and chord length code data.

15. An automatic performance apparatus according to claim 14, further comprising:

a mode setting means for setting a play mode or a recording mode; and a directing means for directing not to change the note length code data and the chord length code data stored in said memory means when the one-key melody key and the one-key chord key are operated in said play mode set by said mode setting means, and for directing to rewrite the note length code data and the chord length code data stored in said memory means when said one-key melody key and said one-key chord key are operated in said recording mode set by said mode setting means.

16. An automatic performance apparatus according to claim 13, wherein a melody and a corresponding chord are stored in successive memory locations of said memory means, said single address designation means causing said chord and following melody to be read out sequentially from said memory means responsive to operation of said one-key melody key.

* * * * *

UNITED STATES PATENT AND TRADEMARK OFFICE

CERTIFICATE OF CORRECTION

PATENT NO. : 4,633,751

DATED : Jan. 6, 1987

INVENTOR(S) : FUKAYA et al

It is certified that error appears in the above-identified patent and that said Letters Patent is hereby corrected as shown below:

Column 12, line 4, "teh" should read -- the --

Column 18, line 34 (Claim 10), "means means" should read -- means --

Column 18, lines 37 - 38, "melodic musical means;" should read -- melodic musical sound information from respective memory locations in said memory means; --

Column 19, line 5 (Claim 13), "memroy" should read -- memory --

Signed and Sealed this

Sixteenth Day of August, 1988

*Attest:*

DONALD J. QUIGG

*Attesting Officer*

*Commissioner of Patents and Trademarks*